US010435987B2

(12) United States Patent
Poluchalla et al.

(10) Patent No.: US 10,435,987 B2
(45) Date of Patent: Oct. 8, 2019

(54) FLOW CONTROL VALVE

(71) Applicant: Schlumberger Technology Corporation, Sugar Land, TX (US)

(72) Inventors: Srinivas Poluchalla, Katy, TX (US); Arun Arumugam, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 112 days.

(21) Appl. No.: 15/167,587

(22) Filed: May 27, 2016

(65) Prior Publication Data

US 2017/0342804 A1 Nov. 30, 2017

(51) Int. Cl.

| | |
|---|---|
| ***E21B 34/14*** | (2006.01) |
| ***E21B 34/00*** | (2006.01) |
| ***E21B 23/00*** | (2006.01) |
| ***E21B 34/10*** | (2006.01) |

(52) U.S. Cl.

CPC ..... *E21B 34/14* (2013.01); *E21B 23/00* (2013.01); *E21B 34/101* (2013.01); *E21B 2034/002* (2013.01)

(58) Field of Classification Search

CPC ..... E21B 34/10; E21B 34/14

See application file for complete search history.

(56) References Cited

U.S. PATENT DOCUMENTS

| | | | | |
|---|---|---|---|---|
| 2003/0183398 | A1* | 10/2003 | Smith | E21B 26/06 166/387 |
| 2010/0038093 | A1* | 2/2010 | Patel | E21B 43/12 166/375 |
| 2010/0212882 | A1* | 8/2010 | Guven | E21B 23/04 166/65.1 |
| 2015/0107902 | A1* | 4/2015 | Downton | E21B 7/062 175/45 |
| 2017/0089170 | A1* | 3/2017 | Asthana | E21B 43/12 |

* cited by examiner

*Primary Examiner* — David J Bagnell
*Assistant Examiner* — Dany E Akakpo

(57) ABSTRACT

A technique facilitates control over at least one flow control assembly position to control fluid with respect to a tubing string. The flow control assembly is disposed along the tubing string and comprises a flow control valve and a motor to control the operational position of the flow control valve. The flow control valve may comprise a plunger and a seal system to provide a seal between the plunger and a surrounding structure. Additionally, the flow control valve comprises a pressure balanced system. The pressure balanced system serves to balance pressure acting on the plunger such that the motor is able to move the plunger by simply overcoming friction of the seal system without overcoming a pressure differential otherwise acting on the plunger.

17 Claims, 6 Drawing Sheets

FLOW CONTROL VALVE

BACKGROUND

Hydrocarbon fluids, e.g. oil and natural gas, are obtained from a subterranean geologic formation, referred to as a reservoir, by drilling a well that penetrates the hydrocarbon-bearing formation. Once a wellbore is drilled, various forms of well completion components may be installed to control and enhance the efficiency of producing fluids from the reservoir. One piece of equipment which may be installed is a flow control valve. Flow control valves function to choke flow from a well annulus into a tubing in the case of a production valve and from an interior of the tubing to the surrounding annulus in the case of an injection valve. A motor may be used to shift a valve mechanism toward a closed or open position to achieve the desired fluid flow through the flow control valve. Pressure differentials act against the valve mechanism, and sufficiently high pressure differentials sometimes created during fluid flow can limit the ability of the motor to shift the flow control valve to the desired position.

SUMMARY

In general, a system and methodology are provided for controlling fluid flow via a flow control assembly. The flow control assembly is disposed along a tubing string and comprises a flow control valve and a motor to control the operational position of the flow control valve. The flow control valve has a plunger and in some applications comprises a seal system to provide a seal between the plunger and a surrounding structure. Additionally, the flow control valve comprises a pressure balanced system. The pressure balanced system serves to balance pressure acting on the plunger such that the motor is able to move the plunger by simply overcoming limited friction, e.g. friction associated with the seal system, without overcoming a pressure differential otherwise acting on the plunger.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention.

However, it will be understood by those of ordinary skill in the art that the present invention may be practiced without these details and that numerous variations or modifications from the described embodiments may be possible.

The disclosure herein generally relates to a system and methodology for controlling fluid flow, e.g. fluid flow in a wellbore. For example, a flow control assembly may be disposed along a tubing string, e.g. a production and/or injection tubing string, deployed along the wellbore. The flow control assembly comprises a flow control valve and an actuator mechanism, e.g. a motor, to control the operational position of the flow control valve. The flow control valve has a plunger which may be selectively moved by the actuator mechanism toward the closed or open positions. In at least some embodiments, the flow control valve also comprises a seal system to provide a seal between the plunger and a surrounding structure. Additionally, the flow control valve comprises a pressure balanced system. The pressure balanced system serves to balance pressure acting on the plunger such that the actuator mechanism is able to move the plunger by simply overcoming limited friction, e.g. friction associated with the seal system, without overcoming a pressure differential otherwise acting on the plunger. Movement of the plunger may be used to selectively open or close a tubing string port so as to control flow of fluid into or out of the tubing string via the tubing string port.

In some embodiments, the actuator mechanism may be controlled to enable incremental displacement of the plunger to selectively control the amount of fluid flow allowed by the flow control valve into or out of the tubing string. During, for example, injection or production operations, displacement of the plunger may be used to increase or decrease the injection or production flow rates of fluids into or out of a surrounding reservoir. With multiple flow control valve assemblies located along the well tubing string, the flow rate of fluids into or out of multiple well zones may be independently controlled by controlling individual actuation mechanisms and corresponding plungers via a suitable control system.

Figure 1:
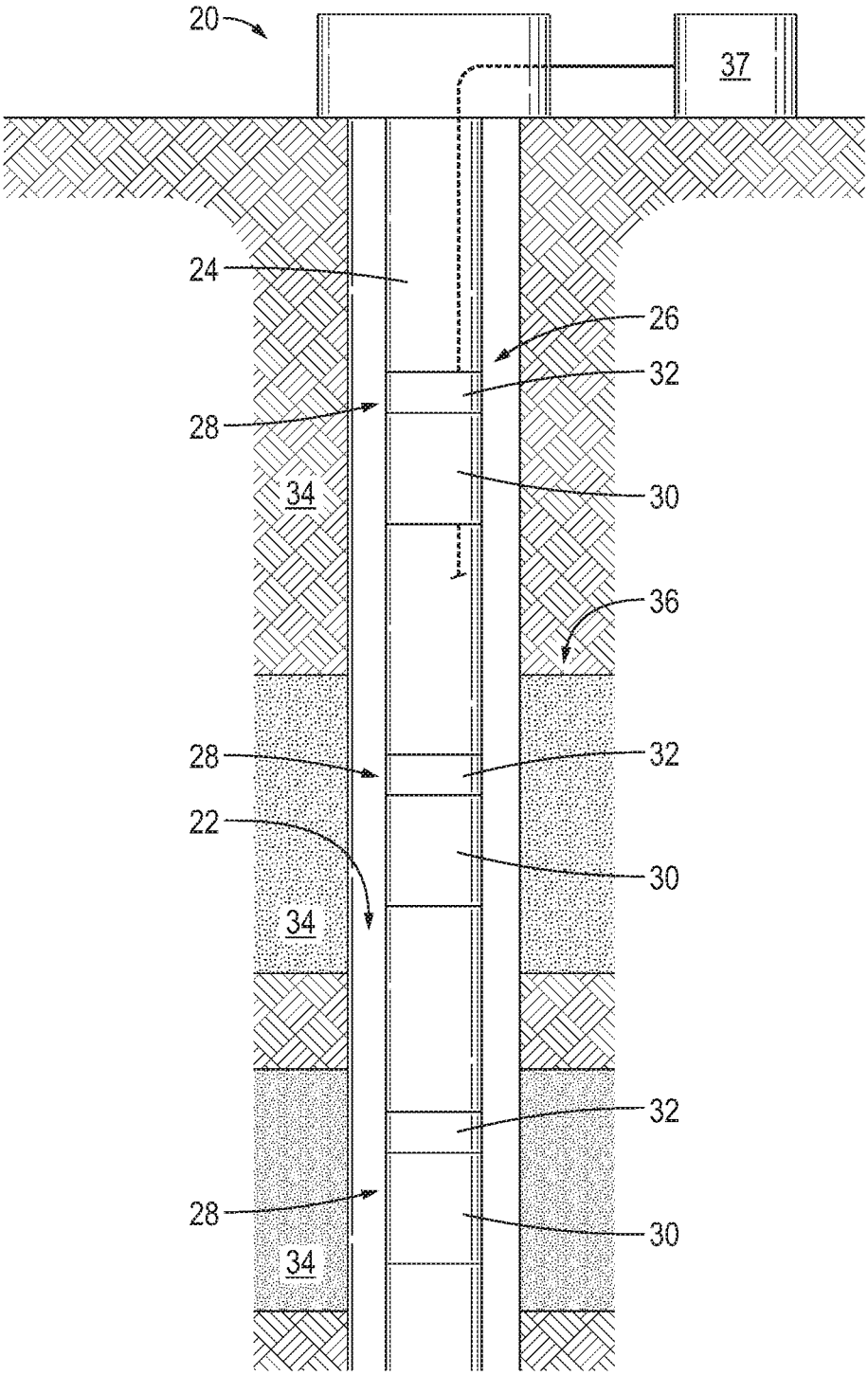
FIG. 1 is a schematic illustration of a well system deployed in a wellbore and including a plurality of flow control valve assemblies, according to an embodiment of the present invention.

Referring generally to FIG. 1, an embodiment of a well system 20 for controlling flow of fluid in a wellbore 22 is illustrated. In this embodiment, well system 20 comprises a tubing string 24 which may include various types of downhole equipment 26. The tubing string 24 and downhole equipment 26 further comprise at least one and often a plurality of flow control valve assemblies 28. Each flow control valve assembly 28 comprises a flow control valve 30 coupled to a corresponding actuator mechanism 32, e.g. motor. The flow control valve assemblies 28 may be used to control, for example, the inflow of reservoir fluid or the outflow of injection fluid with respect to a plurality of well zones 34 in a surrounding reservoir 36. It should be noted that downhole equipment 26 may comprise a variety of packers and other equipment designed to isolate the various well zones 34 along wellbore 22. In at least some embodiments, the flow control valve assemblies 28 may be independently controlled via a control system 37, such as a surface located computer-based control system.

Figure 2:
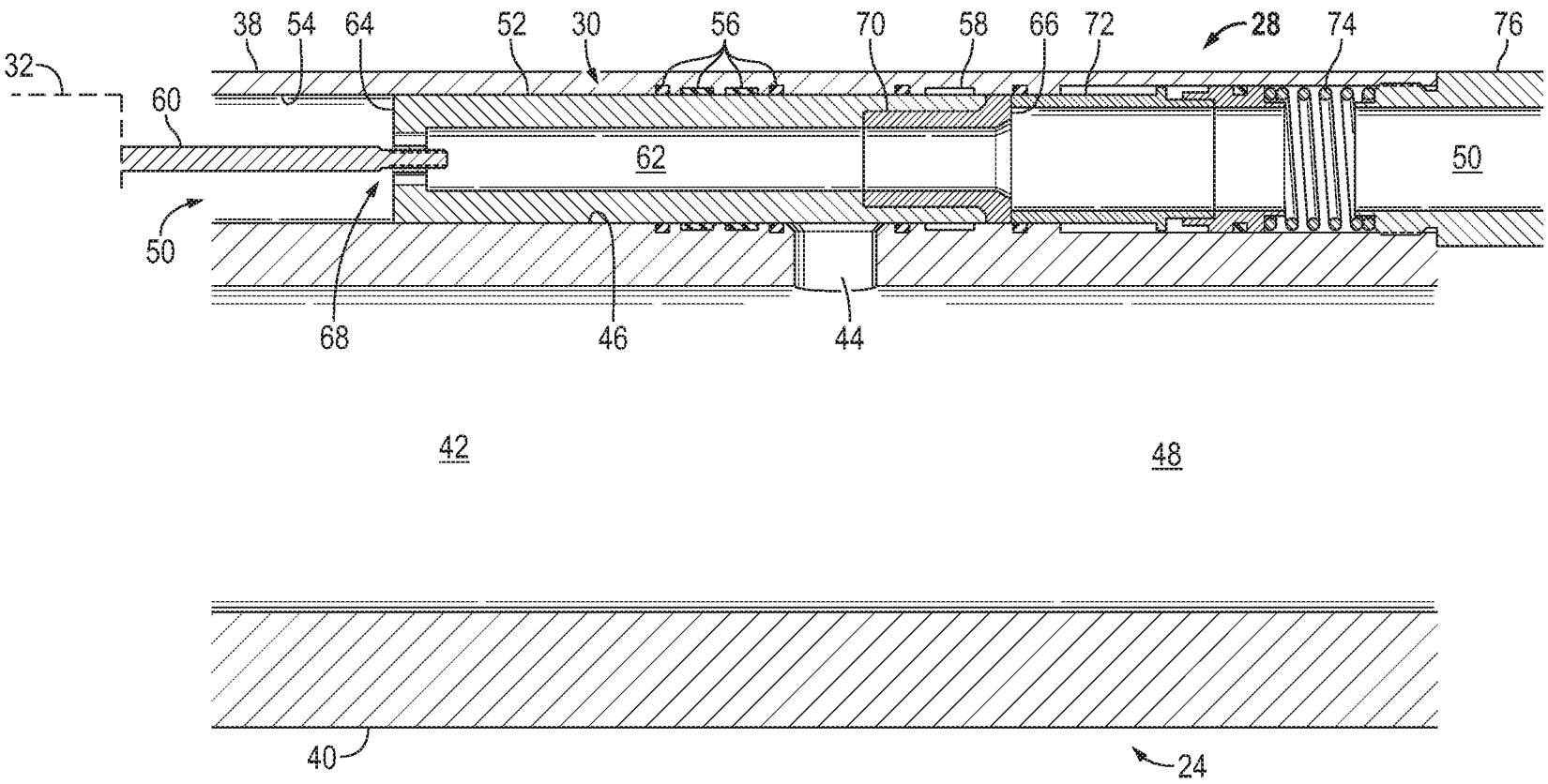
FIG. 2 is a cross-sectional view of an example of a flow control valve mounted along a tubing, according to an embodiment of the present invention.

Referring generally to FIG. 2, a cross-sectional illustration is provided of an embodiment of control valve assembly 28 having flow control valve 30 mounted in a side housing 38 positioned along a primary tubing 40 having an internal flow passage 42. The primary tubing 40 may comprise, for example, production tubing and/or injection tubing combined with the side housing 38 to form a portion of the tubing string 24. In some embodiments, the side housing 38 may be integrally formed with tubing 40, e.g. as a side pocket mandrel. In the example illustrated, at least one tubing string port 44 extends through a sidewall forming primary tubing 40 to connect the internal flow passage 42 of tubing 40 with an interior 46 of side housing 38. The internal flow passage 42 is exposed to a tubing pressure 48 along the interior of tubing string 24, and the interior 46 is fluidly exposed to surrounding reservoir 36 and a reservoir pressure 50.

In the embodiment illustrated, the flow control valve 30 comprises a piston, e.g. plunger, 52 which is slidably received within a corresponding cylinder 54 formed by side housing 38. The plunger 52 may be sealed with respect to the corresponding cylinder 54 via a plurality of seals 56. Additionally, a choke seal or seals 58 may be located along the corresponding cylinder 54 to suitably engage an outer surface of the plunger 52 when the flow control valve 30 is in a closed position with respect to tubing string port(s) 44, as illustrated in FIG. 2.

The piston/plunger 52 may be coupled with actuator mechanism 32 via a suitable rod 60 or other linkage mechanism. By way of example, the actuator mechanism 32 may comprise a motor, e.g. a screw motor or linear motor, controllable by surface controller 37 or other suitable controller to move plunger 52 via rod 60 linearly along corresponding cylinder 54. As illustrated, an internal plunger passage 62 extends longitudinally through the plunger 52 including through a first end 64 of the plunger 52 on the actuator side and through a second end 66 on the opposite side of plunger 52. The internal plunger passage 62 serves as part of an overall pressure balanced system 68 which balances pressure acting against the first end 64 and the second end 66 of plunger 52, thus enabling shifting of plunger 52 without having to overcome a pressure differential.

Depending on the application, the flow control valve 30 may comprise various other components. By way of example, the flow control valve 30 may comprise an insert 70 coupled into plunger 52 at plunger end 66. The insert 70 may be formed of a durable material, e.g. carbide, to protect the plunger 52 against erosion from fluid flow and against damage from contact with other components. For example, the insert 70 may be positioned to engage a spring-loaded, protective sleeve 72.

Figure 3:
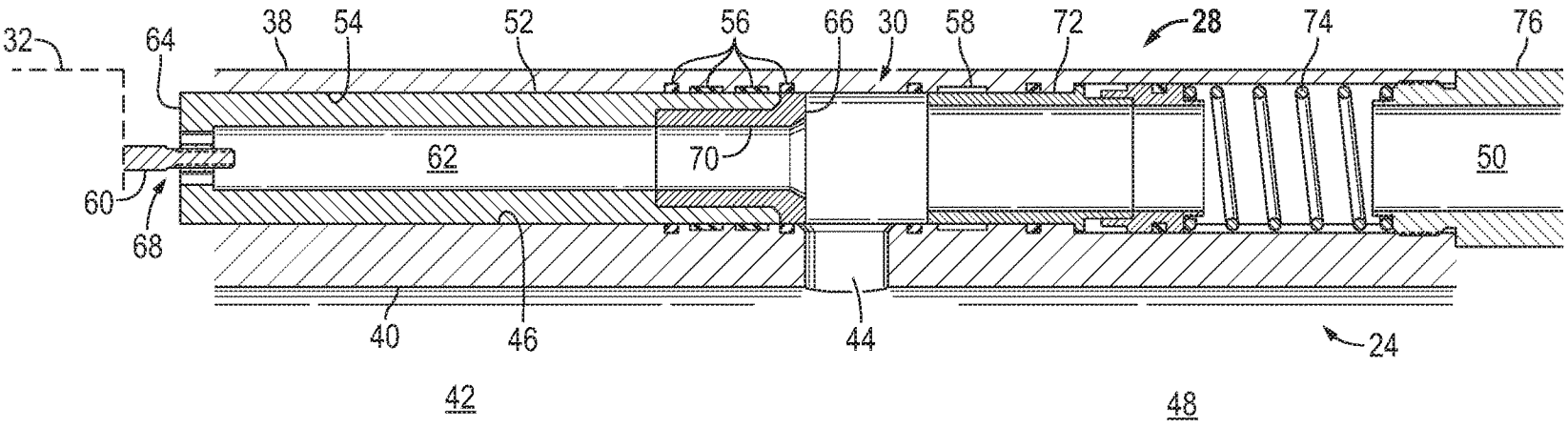
FIG. 3 is a view similar to that of FIG. 2 but showing the flow control valve in a different operational position, according to an embodiment of the present invention.

Regardless of the inclusion of insert 70, the protective sleeve 72 may be positioned to slide and cover choke seal(s) 58 when plunger 52 is actuated to an open flow position, as illustrated in FIG. 3. The protective sleeve 72 may be slidably located within a corresponding cylinder 54 of side housing 38 and may be spring biased toward the choke seal 58 via a spring member 74. By way of example, the spring member 74 may comprise a coil spring or other suitable biasing member. In the illustrated example, the spring member 74 is trapped between protective sleeve 72 and a tubing member 76 exposed to reservoir pressure and threadably, or otherwise, engaged with side housing 38.

When the flow control valve 30 is closed, as illustrated in FIG. 2, the pressure balanced system 68 effectively balances pressure across the plunger 52. For example, the internal plunger passage 62 of pressure balanced system 68 enables the reservoir pressure 50 to be experienced at the first end 64 and second end 66 of the piston plunger 52. Because the pressure is balanced across the plunger 52, shifting of the plunger can be achieved via the motor or other actuator mechanism 32 by simply overcoming the friction forces of the seal system, e.g. seals 56, 58, to move the plunger 52 to a desired operational position. This force to move plunger 52 is much lower than with conventional designs in which movement of a flow control piston involves overcoming both frictional forces and the forces resulting from differential pressure acting on the flow control piston.

When the flow control valve 30 is open to flow through tubing string port 44, as illustrated in FIG. 3, the pressure also is balanced across plunger 52. Because of pressure balanced system 68 and its plunger passage 62, the tubing pressure 48 and reservoir pressure 50 may be equalized at both first end 64 and second end 66 of plunger 52. During closure of the flow control valve 30 from the open position of FIG. 3 to the closed position of FIG. 2, the plunger is moved toward protective sleeve 72. The actuator mechanism/motor 32 overcomes the friction of seals 56 and subsequently the friction of choke seals 58 and the spring bias of protective sleeve 72 as the plunger 52 is moved to the fully closed position. However, pressure balanced system 68 and its internal plunger passage 62 ensure operation of the actuator mechanism 32 without overcoming a pressure differential that would otherwise act against the plunger 52.

Because the plunger 52 does not have to be moved against differential pressures between the reservoir pressure 50 and the tubing pressure 48, the flow control valve 30 may be utilized in higher differential pressure environments with a relatively lower force motor 32 or other lower force actuator mechanisms. Additionally, a higher flow rate can be achieved, because erosion is reduced across the piston plunger 52 in the fully open condition, as illustrated in FIG. 3. The illustrated system also enables the use of choke seals 58 without compromising long and durable usage due to the protection provided by protective sleeve 72. Additionally, the plunger 52 can be more easily and efficiently actuated to desired operational positions by the actuator mechanism/motor 32 because the actuator mechanism/motor 32 does not have to work against a high differential pressure.

Figure 4:
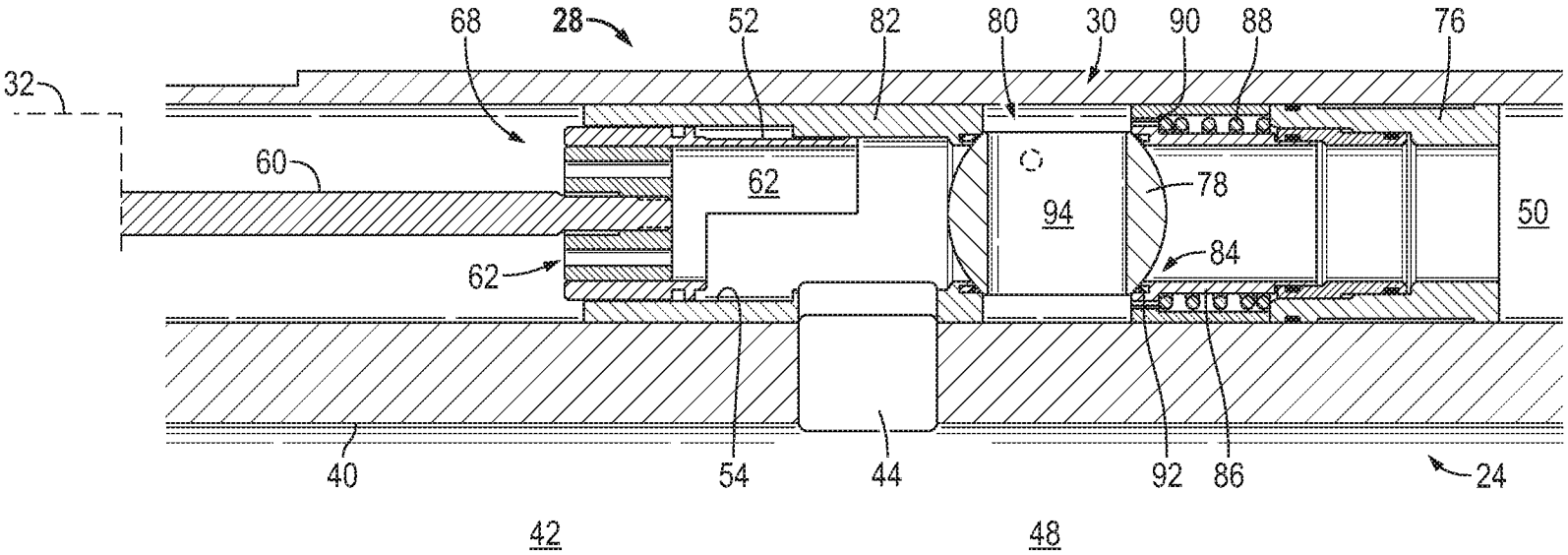
FIG. 4 is a cross-sectional view of another example of a flow control valve mounted along a tubing, according to an embodiment of the present invention.
Figure 5:
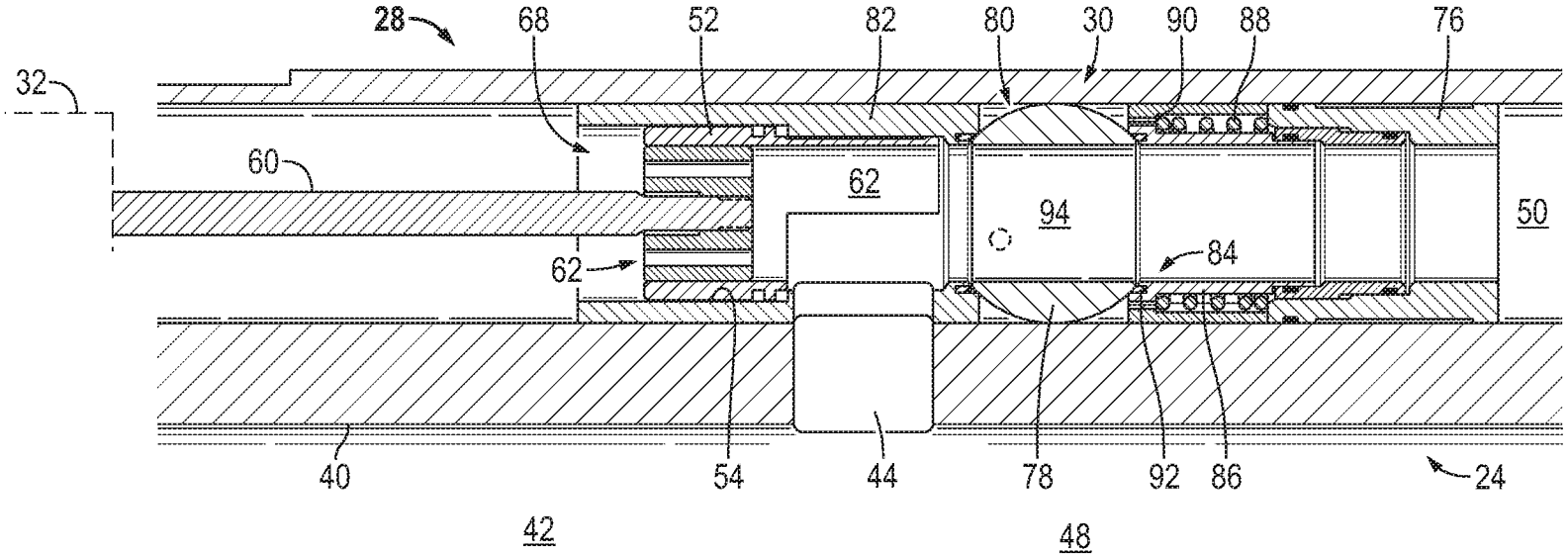
FIG. 5 is a view similar to that of FIG. 4 but showing the flow control valve in a different operational position, according to an embodiment of the present invention.

Referring generally to FIGS. 4 and 5, another embodiment of flow control valve 30 is illustrated. In this example, the actuator mechanism/motor 32 may again be coupled with plunger 52 via rod 60 or another suitable linkage mechanism. The plunger 52 utilizes pressure balanced system 68 to balance differential pressures that would otherwise act on plunger 52 and the overall flow control valve 30. In this embodiment, however, plunger 52 is coupled with a ball 78 of a ball valve 80 having a ball valve structure or housing 82 positioned in cooperation with ball 74. The plunger 52 is constructed to slide longitudinally with respect to housing 82 so as to enable rotation of ball 78 between operational positions.

In this embodiment, the plunger 52 serves in part as a linkage coupled with ball 78 to pivot ball 78 between a closed position, as illustrated in FIG. 4, and an open flow position, as illustrated in FIG. 5. In the closed position, fluid flow along the interior 46 of side housing 38 is blocked but in the open flow position fluid flow along interior 46 and internal plunger passage 62 is permitted. In the open flow position, fluid flow also is enabled between the interior 46/plunger passage 62 within side housing 38 and the flow passage 42 via tubing string port(s) 44. The internal plunger passage 62 again serves as part of an overall pressure balanced system 68 which balances pressure acting against the opposed ends of plunger 52, thus enabling shifting of plunger 52 and ball 78 without having to overcome a pressure differential.

Depending on the application, this embodiment of flow control valve 30 may comprise various other components. By way of example, the flow control valve 30 may comprise a ball valve seat 84 positioned for sliding and sealing engagement with an outer surface of ball 78. The ball valve seat 84 may be part of a sleeve 86 which is spring biased against ball 78 via a spring member 88, e.g. a coil spring or other suitable spring member. The spring member 88 may be trapped between a ridge 90 on sleeve 86 and member 76. In some applications, the ball valve seat 84 also may comprise a seal member 92, such as a choke seal. The seal member 92 seals against the outer surface of ball 78 when the ball is rotated to the closed position of FIG. 4. In some applications, the seal member 92 may comprise at least one elastomeric seal. A ball valve flow passage 94 extending through ball 78 allows flow through the flow control valve 30 when the flow control valve 30 is shifted to the open position of FIG. 5.

As with other embodiments described herein, the interior 46 of side housing 38 may be placed in communication with an annulus surrounding tubing string 24 within wellbore 22. Thus, flow control valve 30 may be selectively opened to allow fluid communication between the annulus of wellbore 22 and the internal flow passage 42 of the tubing string 24. The control valve 30 also may be selectively closed to block fluid communication between the wellbore annulus and the internal flow passage 42. In injection applications, the control valve 30 may be selectively actuated to block or allow outward flow of injection fluid.

When the flow control valve 30 is closed, as illustrated in FIG. 4, the pressure balanced system 68 effectively balances pressure across the plunger 52. Because the pressure is balanced across the plunger 52, the plunger 52 and thus the ball 78 are more easily transitioned between operational positions via the motor or other actuator mechanism 32. For example, a motor 32 with a lower power rating may be used because the motor can be selected based on a lower capability related to simply overcoming the frictional forces associated with seals and with the rotation of ball 78, e.g. overcoming the frictional forces applied by ball valve seat 84. The motor 32 does not have to overcome pressure differentials that would otherwise act against initiating movement of plunger 52. For example, the motor 32 does not have to overcome the pressure differential between the external reservoir pressure and the internal tubing pressure that would otherwise act against transition of plunger 52 and ball 78 from a closed to an open position.

Additionally, this latter embodiment also enables achievement of a higher flow rate because erosion is reduced across the piston plunger 52 when in the fully open condition, as illustrated in FIG. 5. In at least some applications, the seal 92 is used for sealing against ball 78, thus avoiding conventional metal-to-metal contact seals which can be sensitive to debris. The removal of differential pressures or at least the reduction of differential pressures by pressure balanced system 68 enables longevity of use with a wider variety of seal types.

Figure 6:
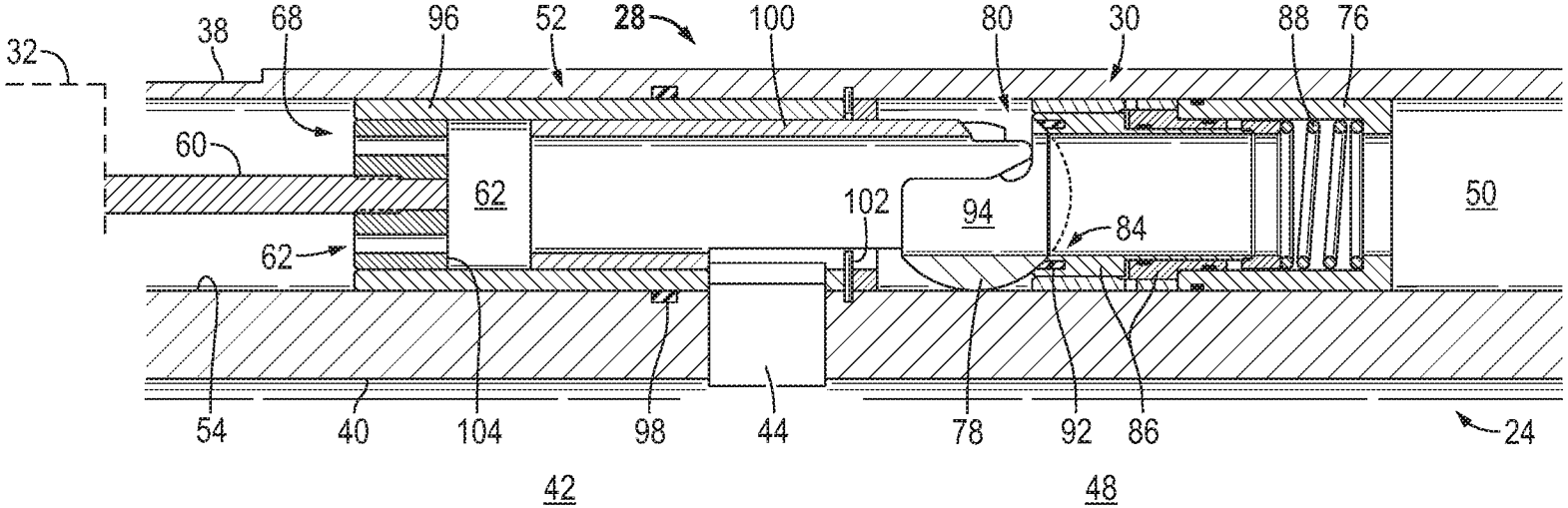
FIG. 6 is a cross-sectional view of another example of a flow control valve mounted along a tubing, according to an embodiment of the present invention.

Referring generally to FIG. 6, another ball valve embodiment is illustrated. In this embodiment, the flow control valve 30 is constructed with adjustable choke capability. As illustrated, the plunger 52 comprises a plunger sleeve 96 slidably received within corresponding cylinder 54 defined by side housing 38. In some embodiments, the plunger sleeve 96 may slide along a scraper and/or seal 98 disposed along the cylinder 54 of side housing 38. The plunger sleeve 96 may be controlled via the actuator mechanism, e.g. motor, 32 via rod 60 for movement between a closed position and various open positions providing different flow capabilities through the tubing string port 44. As with other embodiments described herein, the motor 32 or other actuator mechanism may be controlled via control signals sent from controller 37, such as a processor-based control system. The control system 37 may be implemented at a surface location, at a downhole location, at a location proximate the well, and/or at a location remote from the well.

In this example, the plunger 52 further comprises a yoke 100 coupled between plunger sleeve 96 and ball 78. The plunger sleeve 96 and the yoke 100 are assembled such that once the stroke of the plunger sleeve 96 reaches a certain position, an engagement feature 102, e.g. a catch, couples the plunger sleeve 96 and the yoke 100. Once yoke 100 is engaged with feature 102 of plunger sleeve 96, continued movement of the plunger sleeve 96 in, for example, a pulling direction causes the ball 78 to rotate towards a closed position. As the ball is rotated to the closed position, fluid flow from the annulus surrounding flow control valve 30 to the interior flow passage 42 of primary tubing 40 is choked.

Upon receipt of an opening control signal from control system 37, the motor/actuator mechanism 32 causes rod 60 and plunger 52 to shift the ball 78 to an open position. For example, the plunger sleeve 96 may be moved through a certain stroke length until an abutment 104 engages the yoke 100 and pushes the yoke 100 in a direction which rotates ball 78 towards an open position. When ball 78 is in the open position, the plunger sleeve 96 may be positioned such that fluid is allowed to flow from the surrounding annulus, through the flow control valve 30, and into interior flow passage 42 of the primary tubing 40.

As with other embodiments, the pressure balanced system 68 and its internal plunger passage 62 provide pressure balancing across the plunger 52. The pressure balancing enables use of a relatively lower force motor 32 or other actuator mechanism because the motor 32 does not have to overcome detrimental pressure differentials. Similar to other embodiments described herein, a higher flow rate can again be achieved with this type of embodiment because erosion is reduced across the plunger 52 when in the open condition. The system illustrated in FIG. 6 further enables the use of choke seals, e.g. scraper/seals 98 or other types of choke seals 58, 92 while providing long and durable usage. Various choke capabilities may be achieved by selecting appropriate stroke lengths with respect to both the plunger sleeve 96 and the yoke 100. For example, the stroke length may be increased for certain applications to provide a desired fluid choke capability.

Depending on the application, the components of flow control valve assemblies 28 and of the overall well system 20 can be adjusted to accommodate a variety of structural, operational, and/or environmental parameters. For example, various types of motors or other actuator mechanisms 32 may be used to drive the plunger 52. Similarly, a variety of surface control systems 37, e.g. computer-based control systems, or other control systems may be employed for providing control signals to individual motor/actuator mechanisms 32 of a plurality of the control valve assemblies 28 located along the tubing string 24. The configuration of the plunger 52 and the pressure balanced system 68 also may be adjusted according to the parameters of a given application. For example, the passage 62 of pressure balanced system 68 may comprise a plurality of passages disposed along various routes through the plunger 52.

Additionally, the number and arrangement of flow control valve assemblies 28 can vary substantially from one well application to another. The flow control valve assemblies 28 may be utilized in both lateral and vertical wellbores to achieve the desired flow control over fluid flows from surrounding well zones and/or into surrounding well zones. The flow control valve assemblies 28 also may be used with many types of completions strings or other well strings in production operations and/or other types of operations.

Although a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for controlling flow, comprising:

a tubing string having a tubing string port and a flow control valve assembly configured to control fluid flow through the tubing string port, the flow control valve assembly comprising a flow control valve and a motor to control an operational position of the flow control valve, the flow control valve having:

a plunger coupled to the motor via a mechanical linkage;

a seal system to provide a seal between the plunger and a surrounding structure;

a pressure balanced system which balances pressure acting on first and second opposite axial ends of the plunger such that the motor is able to move the plunger by overcoming friction of the seal system without overcoming a pressure differential acting on the plunger, wherein the pressure balanced system comprises at least one internal plunger passage extending longitudinally through the plunger from the first axial end of the plunger to the second axial end of the plunger;

a choke seal to seal off flow when the flow control valve is in a closed position;

a protective sleeve configured to axially slide to protect the choke seal when the flow control valve is in an open position; and a biasing member configured to bias the protective sleeve toward the choke seal.

2. The system as recited in claim 1, wherein the tubing string comprises a plurality of flow control valve assemblies.

3. The system as recited in claim 1, wherein the plunger is slidable adjacent the tubing string port to selectively open or close the tubing string port.

4. The system as recited in claim 1, wherein the plunger is coupled with a ball of a ball valve.

5. The system as recited in claim 1, wherein the plunger is coupled to a ball of a ball valve and is selectively movable to a plurality of choke positions.

6. The system as recited in claim 1, wherein the flow control valve further comprises a carbide insert disposed axially between the plunger and the protective sleeve.

7. The system as recited in claim 6, wherein the carbide insert is configured to contact the protective sleeve when the flow control valve is in the closed position.

8. The system as recited in claim 1, wherein the pressure balanced system comprises a plurality of internal plunger passages disposed along various routes through the plunger.

9. A system for controlling flow, comprising:

a plurality of flow control valve assemblies coupled into a tubing string, each flow control valve assembly comprising:

a flow control valve for controlling opening and closing of a tubing string port to an interior of the tubing string, the flow control valve having a plunger coupled to an actuator mechanism via a mechanical linkage, wherein the actuator mechanism is configured to cause the plunger to shift to selectively open or close the tubing string port, the plunger cooperating with a pressure balanced system to enable shifting of the plunger without overcoming detrimental pressure differentials otherwise resisting movement of the plunger, wherein the pressure balanced system balances pressures acting on first and second opposite axial ends of the plunger using at least one internal passage extending longitudinally through the plunger from the first axial end of the plunger to the second axial end of the plunger, the flow control valve further having a choke seal, a sleeve, and a biasing member configured to bias the sleeve.

10. The system as recited in claim 9, wherein the actuator mechanism is a motor.

11. The system as recited in claim 9, wherein the plunger is coupled to a ball of a ball valve.

12. The system as recited in claim 9, wherein the plunger slides against the choke seal when shifting the flow control valve to a closed position.

13. The system as recited in claim 12, wherein the choke seal is protected by the sleeve when the flow control valve is shifted to an open position.

14. A method for controlling flow in a wellbore, comprising:

positioning a flow control valve along a tubing string located in a wellbore;

selectively transitioning the flow control valve between an open position and a closed position with respect to fluid flow through a tubing string port;

using a plunger to transition the flow control valve between the open and closed positions, wherein the plunger is coupled to an actuator mechanism via a mechanical linkage, wherein the actuator mechanism causes the plunger to linearly transition the flow control valve the open and closed positions;

pressure balancing the plunger using at least one internal passage extending longitudinally through the plunger from a first axial end of the plunger to a second axial end of the plunger to enable movement of the plunger in either an opening direction or a closing direction without resistance due to differential pressures acting on the plunger; and protecting a choke seal of the flow control valve with a protective sleeve and biasing the protective sleeve toward the plunger with a biasing member.

15. The method as recited in claim 14, further comprising locating the plunger in a side housing positioned outside of a primary tubing of the tubing string.

16. The method as recited in claim 15, further comprising orienting the tubing string port to extend through a wall of the primary tubing to an interior of the tubing string.

17. The method as recited in claim 16, further comprising coupling the plunger to a ball of a ball valve.

* * * * *